US007954404B2

(12) United States Patent
Thielges et al.

(10) Patent No.: US 7,954,404 B2
(45) Date of Patent: Jun. 7, 2011

(54) PUNCH DEVICE WITH ADJUSTMENT SUBASSEMBLY AS RETROFIT INSERT OR AS ORIGINAL EQUIPMENT

(75) Inventors: Bruce Thielges, Fridley, MN (US); David A. Berry, Fridley, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 445 days.

(21) Appl. No.: 12/150,551

(22) Filed: Apr. 29, 2008

(65) Prior Publication Data

US 2009/0266209 A1 Oct. 29, 2009

(51) Int. Cl.
*B26D 7/00* (2006.01)

(52) U.S. Cl. ..... 83/140; 83/698.11; 83/698.91; 83/684

(58) Field of Classification Search ..... 83/698.11, 83/698.31, 530, 686, 684, 699.41, 140, 136, 83/698.71, 698.91, 129, 138, 142, 143
See application file for complete search history.

(56) References Cited

U.S. PATENT DOCUMENTS

| | | | |
|---|---|---|---|
| 4,141,264 | A | 2/1979 | Weisbeck |
| 4,375,774 | A | 3/1983 | Wilson et al. |
| 4,765,264 | A | 8/1988 | Bruton |
| 5,020,407 | A | 6/1991 | Brinlee |
| 5,048,385 | A | 9/1991 | Eckert et al. |
| 5,054,347 | A | 10/1991 | Johnson et al. |
| 5,062,337 | A | 11/1991 | Johnson et al. |
| 5,081,891 | A | 1/1992 | Johnson et al. |
| 5,131,303 | A | 7/1992 | Wilson et al. |
| 5,329,835 | A | 7/1994 | Timp et al. |
| 5,647,256 | A | 7/1997 | Schneider |
| 5,832,798 | A | 11/1998 | Schneider et al. |
| 5,839,341 | A | 11/1998 | Johnson et al. |
| 5,884,546 | A | 3/1999 | Johnson |

(Continued)

FOREIGN PATENT DOCUMENTS

EP 1213065 B1 9/2006

(Continued)

OTHER PUBLICATIONS

U.S. Appl. No. 11/583,430, Thielges.

(Continued)

*Primary Examiner* — Phong H Nguyen
(74) *Attorney, Agent, or Firm* — James V. Harmon; Nikolai & Mersereau, P.A.

(57) ABSTRACT

A punch assembly for a punch press has a punch housing with a punch that is slideably mounted for reciprocation along punch axis within the punch housing and at least one resilient member in the housing for yieldably biasing the punch upwardly in the housing along the punch axis. A punch length adjustment subassembly is provided in the punch housing. The subassembly has a base member that is slideable axially but non-rotatably mounted within the housing and a punch head member having an upper end that is positioned to be struck by a punch ram of a punch press for driving the punch downwardly to an operating position. The punch head is mounted for rotation on the punch axis relative to the base member but is held against axial movement relative to the base member. The punch head is operatively associated by a threaded length adjustment connection to the punch and a releasable stop member is connected between the punch head and the base member for preventing rotation of the punch head relative to the base member while the punch assembly is in operation on the punch press. The invention is also directed to the punch head subassembly per se as a retrofit insert to update existing punch assemblies for manual tooless punch length adjustment and tooless punch removal.

12 Claims, 4 Drawing Sheets

U.S. PATENT DOCUMENTS

| | | | |
|---|---|---|---|
| 6,032,566 | A | 3/2000 | Evans et al. |
| 6,047,621 | A | 4/2000 | Dries et al. |
| 6,074,330 | A | 6/2000 | Ostini |
| 6,196,103 | B1 | 3/2001 | Schneider et al. |
| 6,276,247 | B1 | 8/2001 | Helda |
| 6,279,445 | B1 | 8/2001 | Rosene et al. |
| 6,755,110 | B2 | 6/2004 | Ostini |
| 6,782,787 | B2 | 8/2004 | Morehead et al. |
| 6,675,688 | B2 | 1/2005 | Ostini |
| 7,168,356 | B2 | 1/2007 | Rosene et al. |

FOREIGN PATENT DOCUMENTS

| | | |
|---|---|---|
| WO | WO 99/67039 | 12/1999 |

OTHER PUBLICATIONS

U.S. Appl. No. 11/238,380, Morgan.

Cutaway view of Marathon punch holder/punch/stripper assembly, pp. 4 & 6, Mate Precision Tooling, 1295 Lund Blvd., Anoka, MN 55303, copyright 2000.

PUNCH DEVICE WITH ADJUSTMENT SUBASSEMBLY AS RETROFIT INSERT OR AS ORIGINAL EQUIPMENT

FIELD OF THE INVENTION

This invention relates to punching equipment to be used in a punch press and more particularly to tooless punch length adjustment.

BACKGROUND OF THE INVENTION

Many punch assemblies in commercial use such as the punch assembly described in U.S. Pat. No. 4,989,484 while otherwise very good require time-consuming disassembly using hand tools in order to remove the punch to sharpen the punch tip followed by reinstallation and readjustment of the length of the punch. This operation is labor intensive and, of course, lengthens the downtime of the equipment. Reduced press productivity is problematic particularly with respect to punch assemblies used in high-speed automated punch presses and punch assemblies that have a stripper for assisting in the removal of the workpiece from the punch tip. These punch assemblies require almost complete disassembly so that the punch can be removed for sharpening followed by reinstallation of the punch into the punch assembly using hand tools. While manual length adjustment mechanisms have been previously developed as described, for example, in U.S. Pat. Nos. 4,375,774; 5,329,835; 5,647,256; 5,839,341; 5,884,546; 6,755,110; 6,782,787; and 7,168,356, the patented mechanisms are not adapted for upgrading existing punch assemblies of the general type described in U.S. Pat. No. 4,989,484 as well as for original equipment because of the way the punch assembly is constructed. The present invention is directed to providing a solution to this problem as well as other shortcomings of the prior art. All references cited herein shall be considered to be disclosed as fully and completely as though reproduced herein in their entirety.

In view of these and other deficiencies of the prior art, it is a general object to provide manual, i.e. tool-free, length adjustment for a punch assembly which allows the adjustment to be made without disassembly.

A more specific object of the invention is to find a way to enable a punch assembly of the kind described in U.S. Pat. No. 4,989,484 to be upgraded by the owner so that it can be manually adjusted without tools or disassembly.

Another object is to provide a manually adjustable punch that is constructed so as to reliably prevent misalignment or uneven wear that could otherwise occur between various punch assembly components.

Another object of the invention is to enable the punch to be removed manually from the punch housing without tools.

Another object is to provide for positive drawbolt retention so as to prevent the drawbolt from accidentally falling out during disassembly.

Yet another object is to provide for tooless adjustment at both ends of the punch assembly, namely, manual punch length adjustment at the top end and manual stripper release at the lower end of the punch assembly.

These and other more detailed and specific objects of the present invention will be better understood by reference to the following Figures and detailed description which illustrate by way of example but a few of the various forms of the invention within the scope of the appended claims. Directions, e.g. "upwardly" and "downwardly," are relative so as to better describe the Figures and are not intended to limit spatial orientation of the invention as a whole.

SUMMARY OF THE INVENTION

The present invention provides a punch length adjustment subassembly at the upper end of a tubular punch housing that holds a punch member and punch return spring. The punch length adjustment subassembly which is removably mounted in the punch housing above the punch includes an outer tubular base member that is slideable axially in the punch housing but is non-rotatably mounted therein. A punch length adjustment member which is mounted within the base member has a punch head at its upper end that is positioned to be struck by a punch ram of the punch press for driving the punch downwardly to its operating position. The adjustment member is rotatably mounted on the punch axis relative to the tubular base member but is held against axial movement relative to the base member. The punch head has a lower component which is operatively associated by means of a threaded length adjustment connection for changing the distance between the operating tip of the punch and the upper end of the punch head and a releasable stop member is provided between the punch head and the base member for preventing rotation of the punch head relative to the base member while the punch assembly is in operation on the punch press.

DETAILED DESCRIPTION OF THE PREFERRED EMBODIMENT

Figure 1:
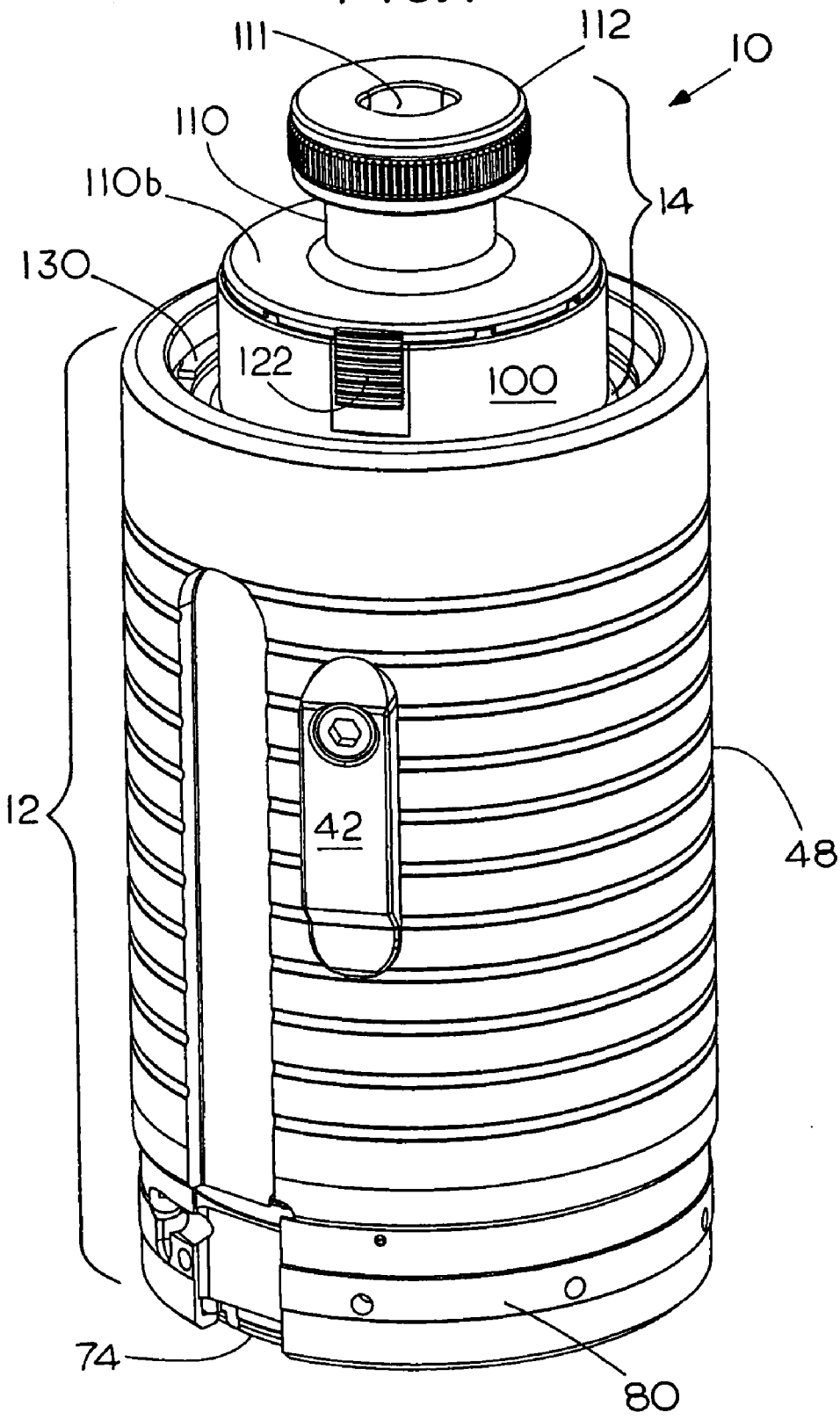
FIG. 1 is a perspective view of one preferred form of the invention.
Figure 2:
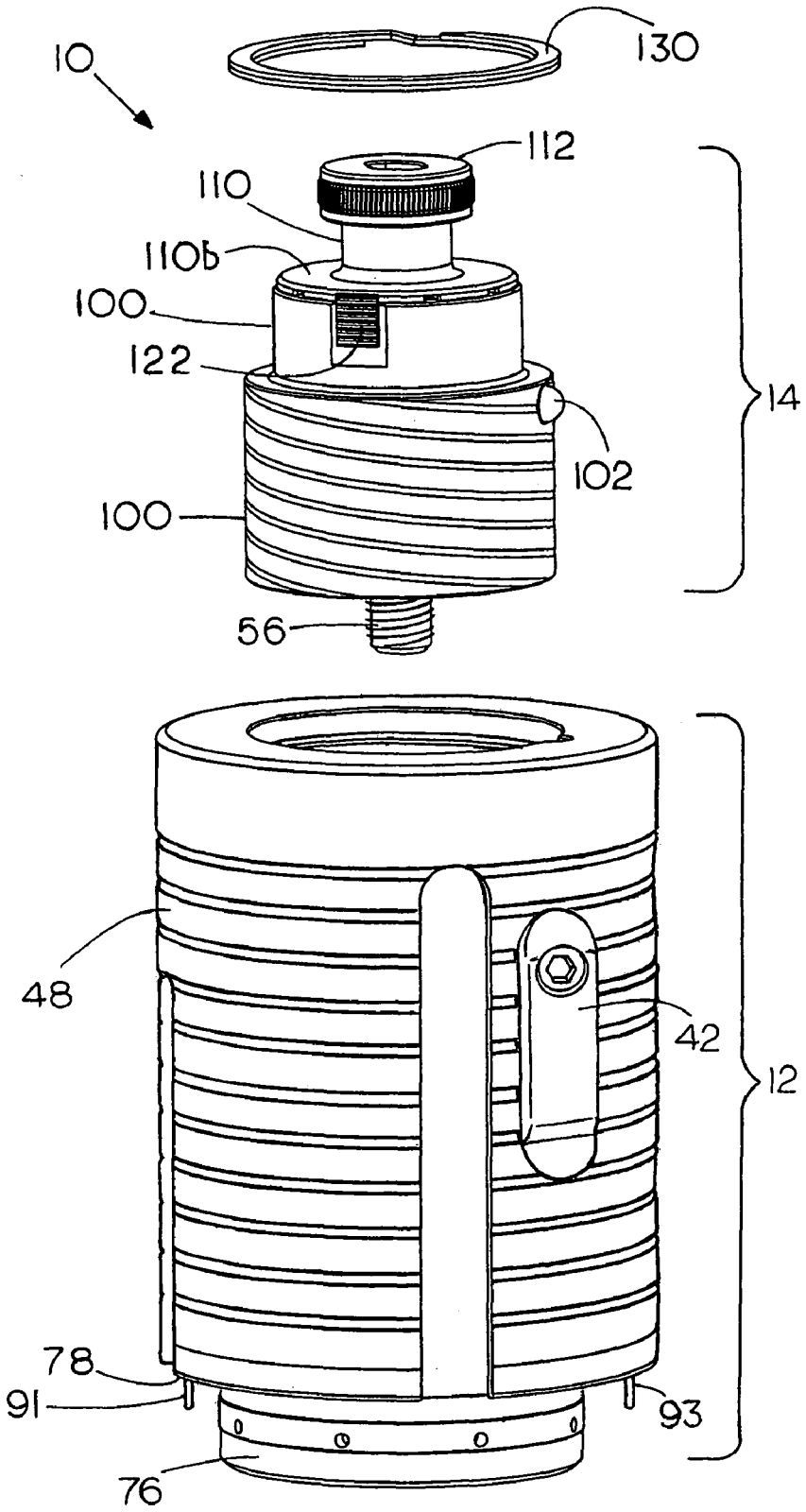
FIG. 2 is an exploded perspective view to show the punch length adjustment subassembly above the punch assembly which is shown with the stripper removed.
Figure 3:
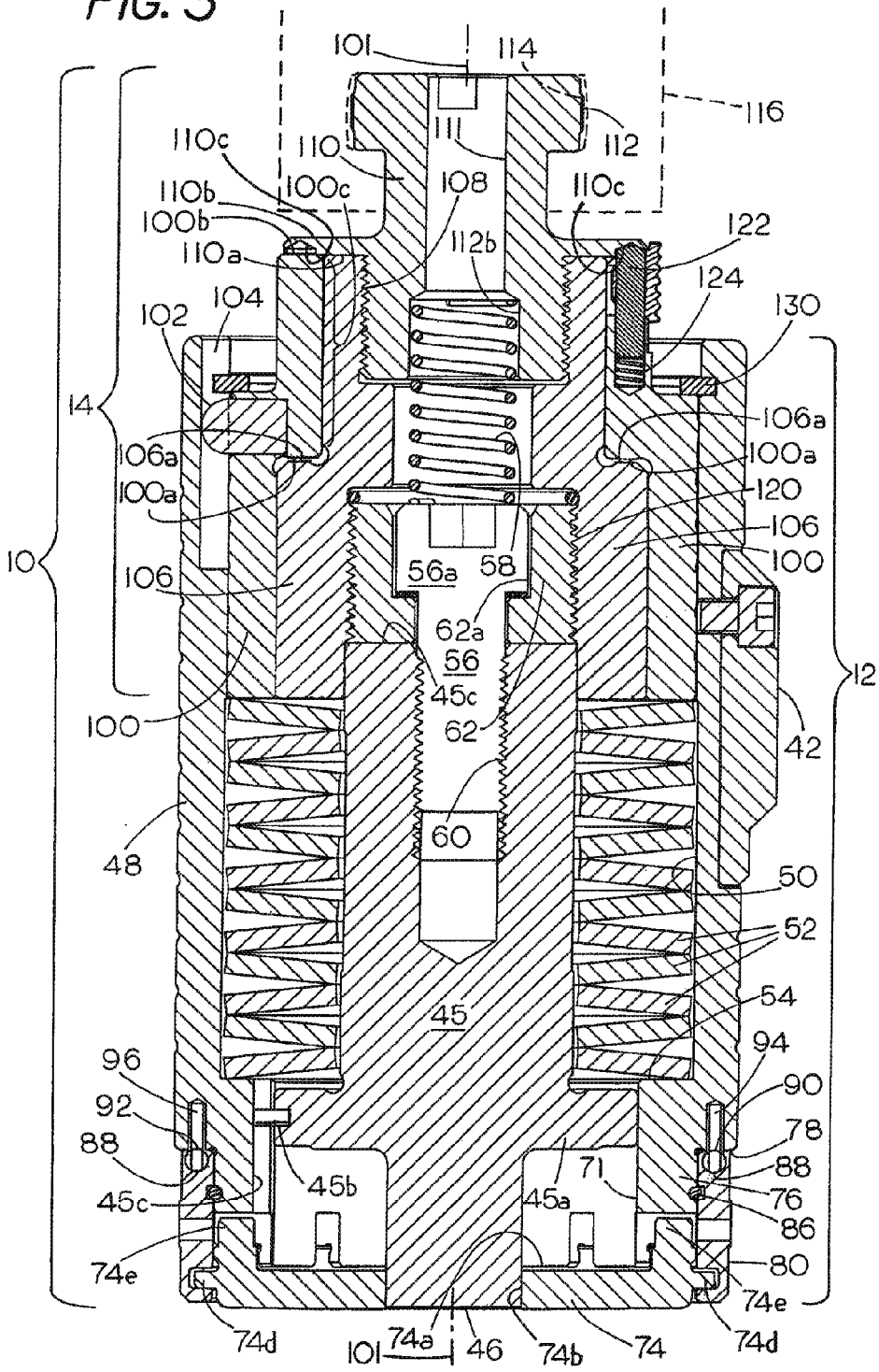
FIG. 3 is a vertical sectional view taken on line 3-3 of FIG. 1 on a larger scale.

Refer now to the Figures and particularly to FIGS. 1-3. As shown best in FIGS. 1 and 2, the complete punch assembly indicated by the numeral 10 includes a punch housing and spring assembly 12 and a punch length adjustment subassembly 14 which fits into the top of the punch housing and spring assembly 12.

Refer now to FIG. 3 which illustrates the internal construction of the punch assembly 10. The punch assembly 10 includes a generally tubular punch housing or sleeve 48 of hardened and ground steel having a central longitudinal bore 50 that encloses the punch 45 and a punch retraction spring assembly 52 which in this case comprises a stack of disc or Belleville springs of annular configuration that during operation are compressed between a shoulder 54 at the bottom of the bore 50 and the lower end of a tubular punch head base 100 for retracting the punch 45 after each punch stroke. The unitary punch length adjustment subassembly 14 is made up of three major parts: a punch head 110, a punch head sleeve 106, and the punch head base 100, all of which will be described in more detail below. The term "unitary" means that the subassembly 14 holds together as a self-contained unit that can be marketed, shipped, and installed as an integrated component.

The punch 45 is mounted for reciprocation along the punch axis 101 within the spring assembly 52 and is secured at its upper end to a punch length adjustment platen 62 by means of a drawbolt 56 having a head 56*a* countersunk in a bore 62*a* within platen 62. The drawbolt is held in place by means of a spring, in this case a helical ejection spring 58, the top end of which abuts a seat at the upper end of bore 112*b* that is countersunk into the lower end of the punch head 110. The ejection spring 58 yieldably biases the drawbolt 56 downwardly so as to eject the punch and a punch stripper 74 when they are released as will be further described below. When assembled, the drawbolt 56 is tightly screwed into the punch 45 at 60 to fasten the punch length adjustment platen 62 to the upper end of punch 45. The punch extends axially through the center of the Belleville springs and has a punch point 46 for engaging and cutting or forming a workpiece (not shown) placed below the punch assembly 10. An enlarged flange 45*a* near the lower end of the punch 45 is slideably received within a bore 71 at the lower end of the sleeve 48 and can, when desired, be provided with a radially extending key or pin 45*b* that slides in a longitudinally extending keyway 45*c* within the housing 48.

Figure 3A:
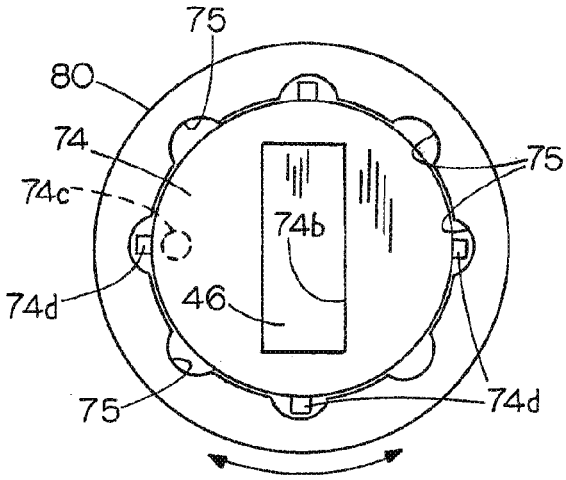
FIG. 3A is a bottom view of the punch assembly of FIGS. 1-3.

During use, the punch point 46 at the operating end of the punch is guided by an opening 74*b* within a removable stripper plate 74. The stripper plate 74 is circular and, in this case cup-shaped, having an internal central recess 74*a* surrounding the punch opening 74*b* of the proper size and shape to fit the punch point 46. The stripper plate 74 is provided with a plurality, e.g. eight or, in this case four, radially extending lugs 74*d*. In addition, an orientation means is provided comprising either a longitudinally extending orientation pin or lug 74*c* (FIG. 3A) which projects into a recess within the housing 48, or if needed, four circumferentially distributed lugs 74*e*.

As seen in FIG. 3, the lower end of the sleeve 48 is provided with a circular boss 76 surrounded by a downwardly facing shoulder 78 to receive a stripper plate retaining member or locking ring 80. Two aligned, circumferentially extending grooves are provided on the boss and on the locking ring 80 respectively to receive a snap ring 86 (FIG. 3) for holding the locking ring 80 rotatably in place after assembly. The locking ring 80 is provided with an upwardly facing circumferentially extending groove 88 to receive positioning springs 90 and 92 which are mounted, in this case between a pair of diametrically opposed pins 94 and 96 affixed to the locking ring 80 and a second pair of diametrically opposed pins 91 and 93 (FIG. 2) that are secured to the sleeve 48. To remove the stripper 74, the locking ring 80 is rotated manually on the housing 48 against the compression springs 90 and 92 thereby releasing the stripper 74 which is normally held in place within the locking ring 80 by means of the lugs 74*d*. By turning the stripper locking ring 80 counterclockwise, in this case 10°, the stripper 74 will be released with no wrenches required. The lugs 74*e* are then free to drop through any one of eight circumferentially distributed index slots 75 (FIG. 3A) in the lower end of the stripper locking ring 80 for allowing the stripper 74 to be set at 45° increments about the punch axis 101. While other retaining devices can be used for holding the stripper 74 in place, an example of one suitable mechanism is described in more detail in U.S. Pat. No. 4,989,484 which is incorporated herein by reference. Although a metal stripper plate 74 has been shown, other known forms of strippers such as an elastomeric stripper formed, for example, from an elastic polyurethane plastic can be used in place of the steel stripper plate 74, if desired.

The punch length adjustment subassembly 14 will now be described in more detail in connection with FIGS. 2-5. Subassembly 14 includes an outer tubular base member 100 that is mounted for axial sliding movement within the housing 48 but is prevented from rotating about the punch axis 101 by means of a key 102 that projects into an axial slot 104 in housing 48. The base 100 is therefore non-rotatably mounted in the housing 48. A punch head comprises an upper punch head component 110 and a lower punch head sleeve component 106. The sleeve 106 is rotatably mounted within the tubular base 100. A central bore 111 extends through the punch head 110 to provide hand tool access to bolt 56. At the top of the punch head 110 is a tang 112 that is adapted to fit during operation into a horizontal slot 114 within a vertically reciprocating ram 116 which forms a part of a suitable commercially available punch press for imparting movement to the punch head 110 and punch 45 during operation. The punch head 110 is threaded at 108 into an upwardly opening threaded bore at the upper end of the sleeve 106. Once assembled, the threads 108 are bonded together, for example with a polymeric adhesive such as Loctite® or, if desired, by means of a fastener such as a set screw (not shown) introduced through a hole (not shown) in the base member 100. Thus following assembly, the punch head 110 and sleeve 106 are immovably connected together. It will be seen that the drawbolt 56 does not engage the punch head 110 but is drawn tight against an upwardly facing shoulder within the length adjustment platen 62 to hold the platen in a fixed position against the upper surface 45*c* of the punch 45. A washer can be placed under the head of the bolt 56.

The platen 62 secured to the punch head 110 by a threaded length adjustment connection 120 to enable the operator to change the distance between punch head 110 and the punch 45. Thus the punch head 110 is operatively associated with the punch 45 by means of the threaded adjustable connection 120 to allow adjustment along the punch axis 101 for changing the overall length of the punch from the tip 46 of the punch to the top of the punch head 110. The adjustment is made to allow for the material that is removed when the punch tip 46 is sharpened.

Figure 4:
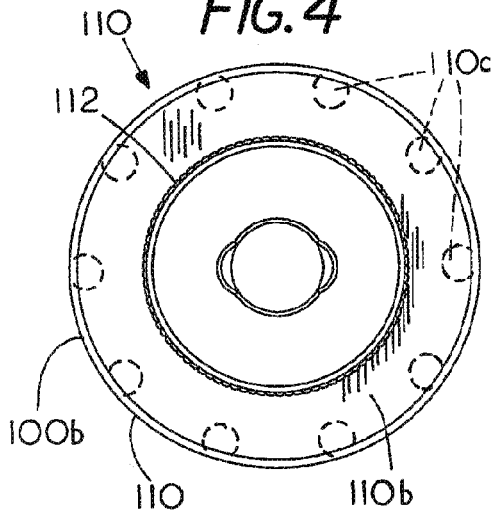
FIG. 4 is top view of the upper portion of the punch head.
Figure 5:
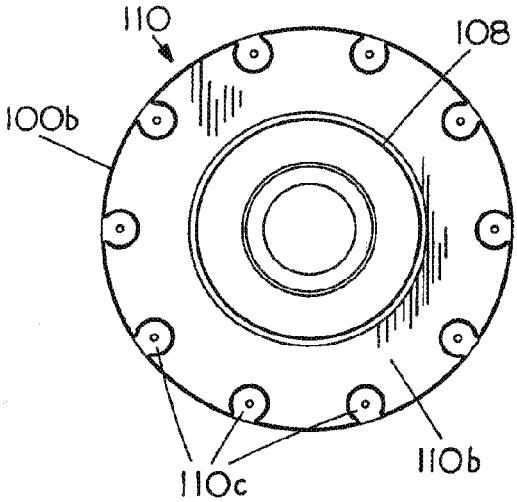
FIG. 5 is a bottom view of the upper portion of the punch head.

As shown in FIGS. 3-5, the punch head 110 is provided with a horizontal radially extending flange 100*b* having a plurality of downwardly opening circumferentially distributed sockets for a manually releasable stop or locking button 122 that is slideably mounted in a vertical bored opening in the base member 100 and is yieldably biased in an upward direction by means of a spring 124.

It can be seen in FIG. 3 that the sleeve 106 has an upwardly facing annular shoulder 106*a* and the punch head has a downwardly facing annular shoulder 100*a*. The base member 100 is rotatably secured but held against up or down movement relative to the punch head 110 and sleeve 106 by an upper segment 100*c* that has a downwardly facing annular shoulder 100*a* and an upwardly facing annular top surface 100*b* which are sandwiched, i.e. captured between the shoulder 106*a* and downwardly facing surface 110*a* respectively so that the base member 100 is prevented from moving either up or down relative to the punch head 110 and sleeve 106.

During operation, when the punch 45 is to be extended relative to the top surface of the punch head 110, the button 122 is pressed downward manually against the compression of spring 124 thereby releasing the punch head 110 as the button 122 is disengaged from the sockets 110*c* for enabling the punch head to be rotated about the punch axis thereby causing the length adjustment threads 120 to extend the platen 62 and punch 45 downwardly as the sleeve 106 rotates relative to the base member 100 which is itself prevented from rotating by the engagement of key 102 in the slot 104. It will be noted that the flange 110*b* and button 122 are both well above the upper end of the housing 48. This gives the operator easy access to the button 122 from the side of the punch assembly 10. It will thus be seen that the punch head 110 and sleeve 106 which are bonded together are able to rotate on the punch axis 101 relative to the tubular base member 100 but are held against axial movement on base 100 by the engagement of annular contact surfaces 110*a* with 110*b*, and 100*a* with 106*a*. In this way, the manually releasable stop comprising the locking button 122 is operatively associated between the punch head 110 and the tubular base 100 to normally prevent rotation of the punch head 110 relative to the tubular base 100 while the punch assembly is being used in a punching operation on the punch press. The lock button 122 by engaging any one of the sockets 110*c* which are distributed circumferentially at uniform intervals enables the punch 45 to be extended or retracted in discrete increments.

When the entire punch assembly 10 is completely assembled as shown in FIGS. 1 and 3, the punch head subassembly 14 is held within the housing 48 by an elastic retaining ring 130. The entire punch assembly 10 can, of course, be sold as original equipment. However, punch head subassembly 14 can also be purchased and installed separately by the owners of existing punch assemblies of the kind described in U.S. Pat. No. 4,989,484 after removing everything within the housing 48 above the Belleville Spring and replacing those parts with the subassembly 14. This enables punch assemblies to be upgraded for tooless adjustment. In this way, existing punch assemblies which require manual disassembly each time the punch needs sharpening can be easily converted to a manually adjustable punch that does not require disassembly from the platen to sharpen or adjust the length of the punch as well as permitting tooless punch removal. The new subassembly 14 can be sold as a retrofit unit for a fraction of the cost of an entire punch assembly.

It will also be seen that the spring 58 holds the drawbolt 56 reliably in place below the punch head 110, thereby providing a captive drawbolt that will not fall out and get lost. The invention also makes it possible by unscrewing the drawbolt 56 for the punch 45 to rise up to meet the fingers of the operator to assure easy removal. Moreover, by removing the retainer 130, the entire subassembly 14 and spring set can be inserted or removed from the housing 48 through the top. The punch 45 can be removed, e.g. for replacement with a different punch by using a hex wrench to fully unscrew the drawbolt 56. Then by turning the locking ring 80, the punch 45, the platen 62, and stripper 74 are allowed to be ejected through the bottom of housing 48 by spring 58. Alternatively, after the stripper is removed, the punch 45 and platen 62 can be easily removed without tools through the bottom by releasing the locking button 122 and turning the punch head 110 to fully unscrew threads 120. The tool tip 46 can then be sharpened and the punch and plates reinserted into the housing. The button 122 is then manually disengaged allowing the punch head 110 to be rotated while observing the punch tip 46 as the length adjustment threads 120 extend or retract the punch tip relative to the stripper 74. The subassembly 14 will also function reliably over an extended period of time since the annular contact surfaces at the top and bottom of the base segment 100*c* distribute punch ram forces evenly around the punch axis 101 and over a wide area that is spaced uniformly from the punch axis thereby preventing misalignment or uneven wear that could otherwise occur.

Many variations of the present invention within the scope of the appended claims will be apparent to those skilled in the art once the principles described herein are understood.

What is claimed is:

1. A punch assembly having a tubular punch housing with a punch therein that is yieldably biased in an upward direction within the housing comprising, (a) a unitary punch length adjustment subassembly adapted to be shipped and installed into the punch assembly as a separate integrated retrofit unit and having an outer tubular base member adapted to slide axially in the punch housing and to be non-rotatably mounted at the upper end of the punch assembly, (1) the unitary punch length adjustment subassembly including a punch head member having an upper end adapted to be struck by a punch ram of a punch press for driving the punch to an operating position, (2) the unitary punch length adjustment subassembly including a sleeve that is mounted within the tubular base member for rotation on the punch axis relative to the tubular base member but is held against axial movement relative to the tubular base member, (3) the punch head is operatively associated by a threaded length adjustment connection to the punch for adjusting distance from a punch tip at the lower end of the punch to an upper end of the punch head, (4) a manually operable releasable stop member is provided as part of the unitary punch length adjustment subassembly between the punch head and the tubular base member for preventing rotation of the punch length adjustment head relative to the tubular base while the unitary punch assembly is engaged in a punching operation on a punch press, and (5) a length adjustment platen is affixed to the punch and the length adjustment connection is an axial threaded connection between the punch head as a part of the unitary punch length adjustment subassembly and the platen wherein after the threaded connection is completely unscrewed the punch and the platen are able to slide out of a bottom end of the housing without the use of hand tools.

2. The assembly of claim 1 wherein a manually releasable stripper plate is mounted upon the lower end of the assembly for guiding a lower end of the punch.

3. A punch assembly having a tubular punch housing with a punch therein that is yieldably biased in an upward direction within the housing comprising, (a) a unitary punch length adjustment subassembly adapted to be shipped and installed into the punch assembly as a separate integrated retrofit unit and having an outer tubular base member adapted to slide axially in the punch housing and to be non-rotatably mounted at the upper end of the punch assembly, (1) the unitary punch length adjustment subassembly including a punch head member having an upper end adapted to be struck by a punch ram of a punch press for driving the punch to an operating position, (2) the unitary punch length adjustment subassembly including a sleeve that is mounted within the tubular base member for rotation on the punch axis relative to the tubular base member but is held against axial movement relative to the tubular base member, (3) the punch head is operatively associated by a threaded length adjustment connection to the punch for adjusting distance from a punch tip at the lower end of the punch to an upper end of the punch head, (4) a manually operable releasable stop member is provided as part of the unitary punch length adjustment subassembly between the punch head and the tubular base member for preventing rotation of the unitary punch length adjustment head relative to the tubular base while the punch assembly is engaged in a punching operation on a punch press, and (5) the unitary punch length adjustment subassembly comprises an upper punch head component and a lower sleeve component that are fastened rigidly together to provide upper and lower annular spaced apart retaining surfaces that face one another and are rotatably engaged with cooperating annular surfaces of the tubular base member for preventing axial movement therebetween.

4. The assembly of claim 3 wherein the punch head and the sleeve component are separate pieces that are connected together so as to capture a segment of the tubular base member for rotation therebetween.

5. The punch assembly of claim 4 wherein the tubular base member is held against axial movement relative to the punch head by a segment of the tubular base member that is sandwiched between opposed retaining surfaces on the unitary punch length adjustment subassembly that face one another and are engaged on the upper and lower surfaces of the segment of the tubular base member positioned therebetween.

6. The assembly of claim 3 including a drawbolt threaded into an upper end of the punch and an ejection spring between the drawbolt and the punch head to eject the punch from the assembly when the punch is released therefrom.

7. A punch assembly for a punch press comprising, (a) a punch housing, (b) a punch slideably mounted for reciprocation along a punch axis within the punch housing, (c) at least one resilient the member in the housing for yieldably biasing the punch upwardly to a retracted position in the housing along the punch axis, (d) a punch length adjustment subassembly operatively associated with the punch and mounted in the punch housing above the punch, (1) the punch length adjustment subassembly having a tubular base member that is slideable axially within the housing but is non-rotatably mounted within the housing, (2) the punch length adjustment subassembly including a punch head having an upper end positioned to be struck by a punch ram of a punch press for driving the punch downwardly to an operating position, said punch head being mounted on the tubular base member for rotation on the punch axis relative to the tubular base member but being held against axial movement relative to the base member, (3) the punch head of the punch length adjustment subassembly being operatively associated with the punch by a threaded length adjustment connection that allows adjustment of the distance between a punch tip at the lower end of the punch and an upper end of the punch head and, (4) a manually operable releasable stop member as a part of the punch length adjustment subassembly between the punch head and the tubular base member for preventing rotation of the punch head relative to the tubular base member while the punch assembly is in operation on the punch press but when released allowing rotation of the punch head to adjust the punch length, and (5) the punch length adjustment subassembly comprises an upper punch head component and a lower sleeve component that are rigidly fastened together to provide upper and lower spaced apart annular retaining surfaces which are rotatably engaged with cooperating annular surfaces of the tubular base member for preventing axial movement therebetween.

8. The punch assembly of claim 7 wherein the punch length adjustment subassembly is a unitary punch length adjustment subassembly that is held together as a self-contained unit.

9. The assembly of claim 7 wherein a manually releasable stripper plate is mounted upon the lower end of the assembly for guiding a lower end of the punch.

10. The assembly of claim 7 wherein the punch head and a sleeve component are separate pieces that are connected together so as to capture a segment of the tubular base member for rotation therebetween.

11. The punch assembly of claim 10 wherein the tubular base member of the punch length adjustment subassembly is held against axial movement relative to the punch head by a segment of the tubular base member that is sandwiched between opposed retaining surfaces of the punch length adjustment subassembly that face one another and are rotatably engaged upon upper and lower surfaces of the segment of the tubular base member positioned therebetween.

12. The assembly of claim 7 including a drawbolt threaded into an upper end of the punch and an ejection spring between the drawbolt and the punch head to eject the punch from the assembly when the punch is released therefrom.

* * * * *